US007685719B2

(12) United States Patent
Hogan et al.

(10) Patent No.: US 7,685,719 B2
(45) Date of Patent: Mar. 30, 2010

(54) CIRCLE CUTTING DEVICE

(76) Inventors: Suzanne Hogan, 30 Sparrow Rd., Bayville, NJ (US) 08721; Youngsang Lee, 8725 57th Rd., 3F, Elmhurst, NY (US) 11373

( * ) Notice: Subject to any disclaimer, the term of this patent is extended or adjusted under 35 U.S.C. 154(b) by 469 days.

(21) Appl. No.: 11/805,545

(22) Filed: May 23, 2007

(65) Prior Publication Data

US 2008/0289195 A1 Nov. 27, 2008

(51) Int. Cl.
*B43L 9/00* (2006.01)
*B26D 3/08* (2006.01)
*B26D 1/12* (2006.01)

(52) U.S. Cl. ..... 30/310; 83/745; 33/27.01

(58) Field of Classification Search ..... 30/300, 30/310; 83/745; 33/27.01, 27.04, 27.07, 33/562, 566

See application file for complete search history.

(56) References Cited

U.S. PATENT DOCUMENTS

| | | | | |
|---|---|---|---|---|
| 2,624,117 | A * | 1/1953 | Paci | 33/27.03 |
| 3,621,574 | A * | 11/1971 | Yanke et al. | 30/280 |
| 4,222,171 | A * | 9/1980 | Malacheski | 33/26 |
| 4,426,781 | A * | 1/1984 | Kufrin | 30/310 |
| 4,782,730 | A * | 11/1988 | Picone et al. | 83/745 |
| 5,007,320 | A * | 4/1991 | Craig et al. | 83/745 |
| 6,286,216 | B1 * | 9/2001 | Braun | 30/310 |
| RE38,354 | E * | 12/2003 | Hsu | 30/310 |
| 6,796,211 | B1 * | 9/2004 | Braunberger | 83/745 |

* cited by examiner

*Primary Examiner*—Hwei-Siu C Payer
(74) *Attorney, Agent, or Firm*—Sofer & Haroun, LLP

(57) ABSTRACT

A rotary disc assembly for use with a cutting tool to cut circles from a material. The rotary disc assembly includes an outer ring frame having an inner flange and a rotary disc, rotatably attached to the inner flange of the outer ring frame. The rotary disc has a radial channel so that when it is placed on the material and the cutting tool is inserted into the radial channel and affixed therein, and when the cutting tool and the rotary disc are rotated relative to the outer ring frame, the material is cut to form a circle.

19 Claims, 6 Drawing Sheets

CIRCLE CUTTING DEVICE

FIELD OF THE INVENTION

The present invention relates to the field of craft products. More particularly, the present invention relates to the field of craft cutting devices.

BACKGROUND OF THE INVENTION

In the field of craft products numerous devices have been made to assist a user in cutting a properly shaped and precisely measured circle from a sheet media, such as craft paper. For example, a basic circle compass may be used to draw a circle on a sheet media and then the circle may be cut using an ordinary pair of scissors. However, such a method for cutting circles is entirely too imprecise as well as too slow for high level craft needs. As such, specialized circle cutting devices have been generated.

One such exemplary prior art circle cutting device is shown in RE 38,354, including a stationary ring board having a rotatable insert, mounted to the stationary ring board using ball bearings. The rotatable insert has a plurality of holes on the surface for receiving a cutting device in order to cut precisely sized circles. This reference does not disclose a radial channel for the insertion of an adjustable cutting tool.

U.S. Pat. No. 4,426,781 to Kufrin discloses a disc cutter capable of cutting two different size discs, having an outer housing and an inner rotary housing carrying the cutter blade and means to adjust the cutter blade. This reference has the disadvantage that it is limited to cutting circles of two sizes only.

U.S. Pat. No. 3,621,574 to Yanke et al. discloses a circle cutter comprising a central disc and a radially adjustable cutting arm. The circle cutter is provided with an open channel which slidably receives the cutting head. This reference does not disclose an inner rotary disc and therefore this circle cutter has the disadvantage that the relatively small radiuses cannot be cut because of the size of the base which must be relatively large to allow the compass to be manipulated.

U.S. Pat. No. 5,007,320 to Craig et al. discloses a compass having a lower surface engageable with the material, a support member rotatably supported on the base and a toolholder mounted on the support member. The support member is provided with an elongated slot and a measurement scale with the toolholder being located in the slot. To adjust the blade, the thumbscrew is loosened and the toolholder assembly slides along the slot and once the correct position is attained, the thumbscrew is tightened. This reference does not disclose an adjustment mechanism comprising a worm screw and an adjustment knob which allows for precise positioning of the blade.

SUMMARY OF THE INVENTION

Cutting a circle from a sheet material is an extremely difficult task. Even those who are blessed with the steadiest hands find it difficult to cut an even circle, wherein the measurement of the radius from any point on the circumference of the circle to the center, is equal. It is even more complicated to attempt to cut a circle of an exact size, or to cut multiple circles of varying sizes which can be arranged one on top of the other in a neat and organized arrangement. In the field of crafts and scrapbooking, circle cutting is a necessary skill. The key to a successful craft or scrapbook is creative decorating. When one cannot cut a circle, one is limited to applying linear shapes, and one's project lacks the creativity that comes with curvature. An ordinary picture or any other sheet media can be transformed and acquires a new look by merely cutting it into a circle or by adding a rounded border. In addition, circle-cuts save space when adhered to a page of a scrapbook, album, or the like, since when a material is cut into a circle the excess border is removed. The circle cutting device of the present invention is easy to use and produces perfectly shaped circles of the designated sizes.

The present invention is also dually functional. The circle cutting device is also capable of drawing precise circles of varying diameters. The circle cutting device of the present invention has an insertion channel into which a drawing tool may be inserted interchangeably with the cutting tool. As such, a user can employ this same device to draw symmetrical circles onto sheet media.

The present invention provides for a rotary disc assembly for use with a cutting tool to cut circles from a material, having an outer ring frame with an inner flange and a rotary disc rotatably attached to the inner flange. The rotary disc has a radial channel for the insertion of a cutting tool. The cutting tool is affixed within the radial channel by a guide and when the cutting tool and the rotary disc are rotated relative to the outer ring frame, the sheet material is cut to form a circle.

In order to move the cutting tool and guide ring along the radial channel, the guide ring is connected on a first side to a slide bar mounted to the underside of the rotary disc. On the opposite side, a worm screw is mounted to the underside of the rotary disc, so that when the worm screw is rotated, complementary screw threads found on the guide ring, move the cutting tool within the axial channel. In this way, the cutting tool is moved precisely and accurately along the channel in order to cut the "perfect" circle.

BRIEF DESCRIPTION OF THE DRAWINGS

The present invention can be best understood through the following description and accompanying drawings, wherein.

DETAILED DESCRIPTION

Figure 1:
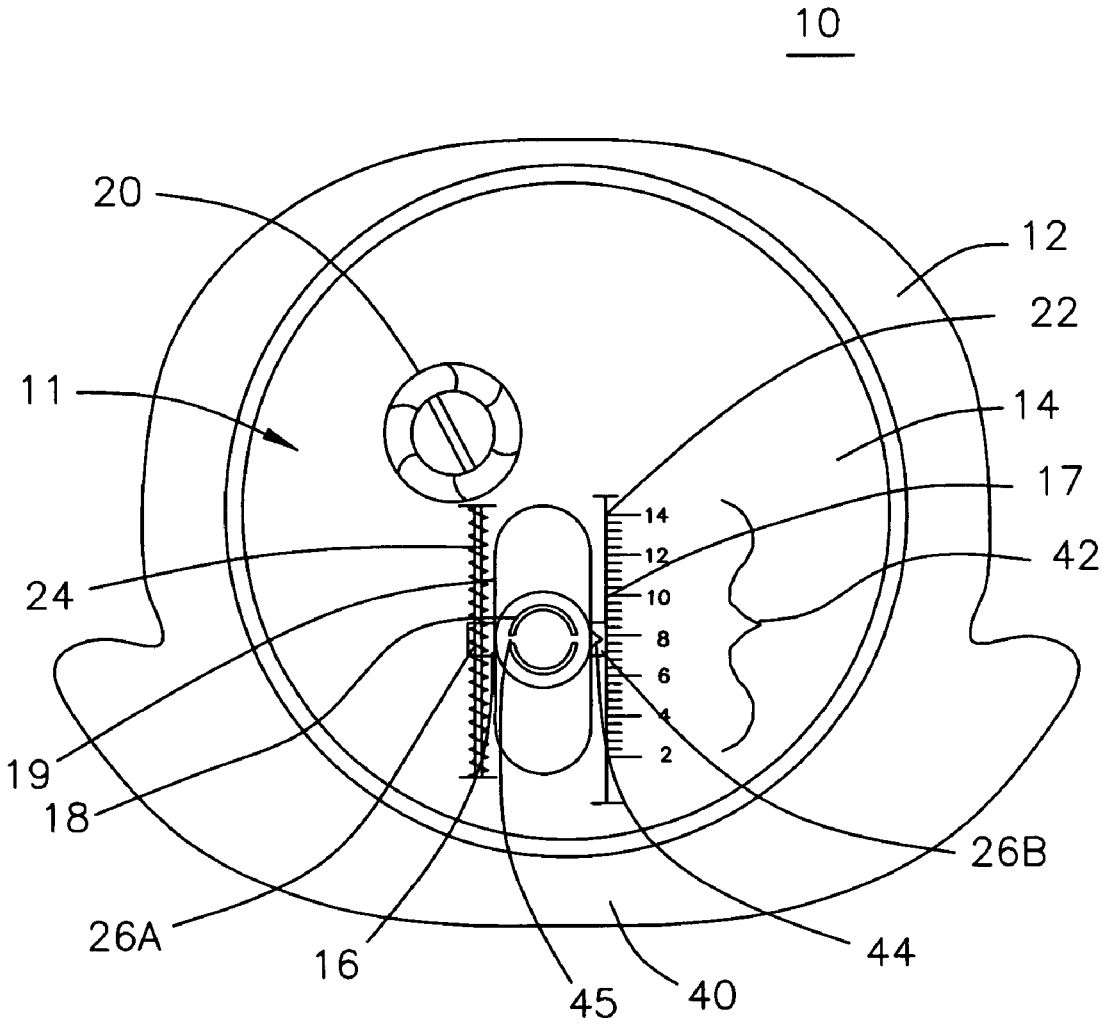
FIG. 1 is a plan view of the circle cutting device, in accordance with one embodiment of the present invention.

Referring to FIG. 1 of the present invention, the circle cutting device 10 is shown having a rotary disc assembly 11 comprising, an outer ring frame 12 and a movable rotary disc 14. Rotary disc 14 is positioned in the central void of outer ring frame 12 for movement relative to outer ring frame 12 which remains stationary. Rotary disc 14 is provided with a radial channel 16 which, in one embodiment, is an elongated opening through rotary disc 14, so that when circle cutting device 10 is placed on the material and cutting tool 60 is inserted into radial channel 16 and affixed therein, and when cutting tool 60 and rotary disc 14 are rotated relative to outer ring frame 12, the material is cut to form a circle.

Radial channel 16 is provided with a first side 17 and a second side 19. A slide bar 22 is mounted to the underside of rotary disc 14 along first side 17 of channel 16. A worm screw 24 is mounted to the underside of rotary disc 14 along second side 19 of channel 16. A guide ring 18 is mounted within radial channel 16 between slide bar 22 and worm screw 24, for receiving cutting tool 60, so that when cutting tool 60 is inserted into guide ring 18, and when worm screw 24 is rotated, guide ring 18 and cutting tool 60 are moved axially along radial channel 16.

Rotary disc 14 is further provided with an adjustment knob 20 mounted on the top side of rotary disc 14 and coupled to worm screw 24, so that when adjustment knob 20 is turned, worm screw 24 is rotated allowing guide ring 18 and cutting tool 60 to move axially along radial channel 16.

In one embodiment of the present invention, rotary disc 14 has a guide 42 having positioning markings along the radial side of radial channel 16. These positioning markers tell the user the diameter or radius of the circle to be cut. In order to prescribe the exact measurement of the circle to be cut, guide ring 18 is to be aligned at the desired positioning marking on guide 42. The markings can be radius measurements in centimeters, inches, or any other indication of size. In one embodiment, guide ring 18 has a radius indicator 44 protruding toward the markings of guide 42. Radius indicator 44 points precisely to the desired measurement, so that the circle cut is of the exact size desired. In another embodiment, guide ring 18 has a slot 45 within the inner wall of ring 18 for the insertion of a corresponding notch 64 on cutting tool 60. The connection between notch 64 and slot 45 secures cutting tool 60 within guide ring 18.

In yet another embodiment of the present invention, outer ring frame 12 has a positioning surface 40 along the outer side of ring frame 12. Positioning surface 40 is wider than outer ring frame 12, in order to allow user to rest their hand on positioning surface 40 thereby securing circle cutting device 10 in the desired position while rotating the cutting tool with the other hand. Positioning surface 40 is typically fabricated from a graspable soft plastic material.

Figure 2:
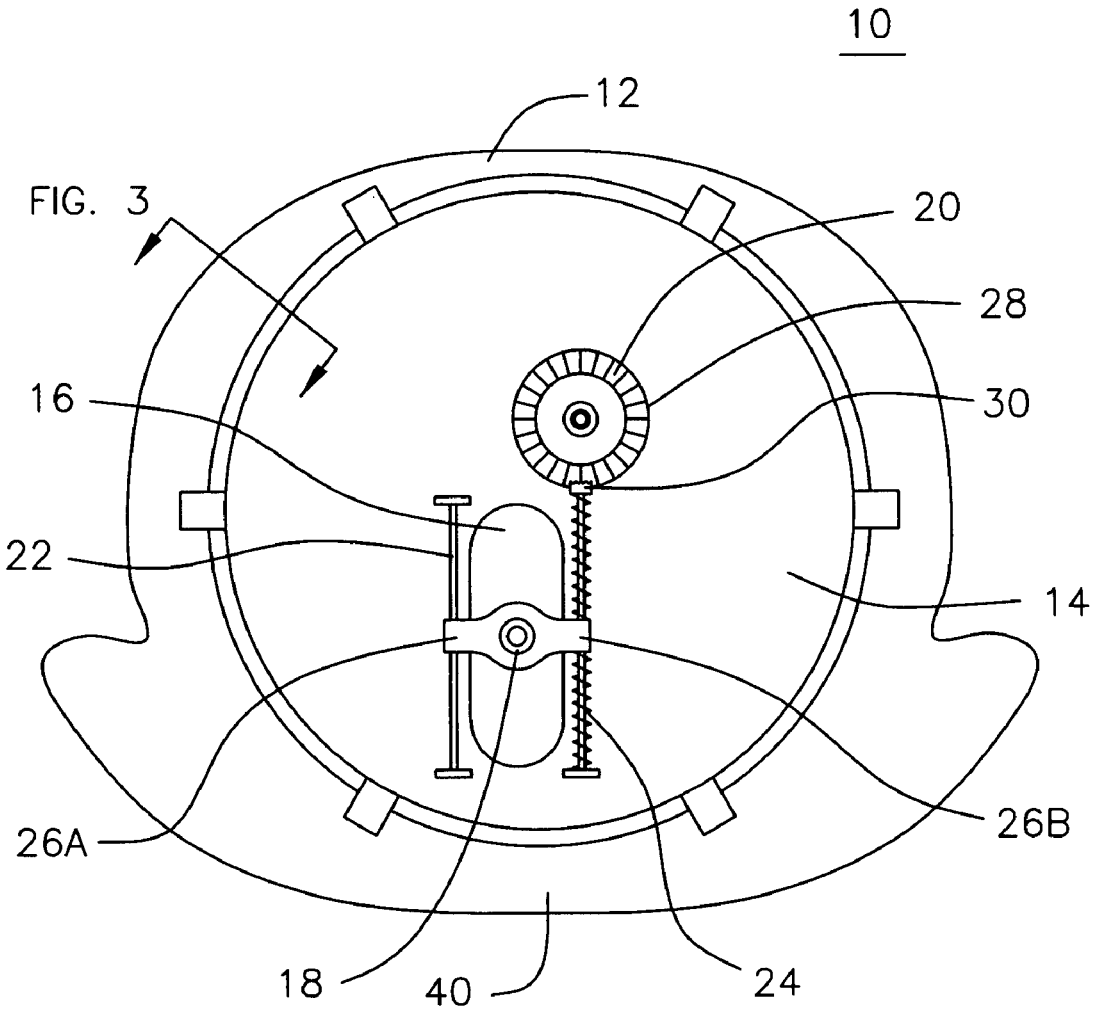
FIG. 2 is a bottom side plan view of the circle cutting device of FIG. 1, in accordance with one embodiment of the present invention.

Referring to FIG. 2, the underside of circle cutting device 10 is shown according to one embodiment of the present invention. A slide bar 22 is mounted to the underside of rotary disc 14 along one side of radial channel 16. Worm screw 24 is also mounted to the underside of rotary disc 14 along the opposite side of radial channel 16. Guide ring 18 is provided with a first tubular opening 26*a* for receiving slide bar 22 and a second tubular opening 26*b* for receiving worm screw 24. The inner side of second tubular opening 26*b* has worm screw threads (not shown) which correspond to the worm screw threads of worm screw 24.

In one embodiment of the present invention, adjustment knob 20 is attached to a gear portion 28 on the underside of circle cutting device 10. Worm screw 24 has a gear head 30 which interacts with gear portion 28. When adjustment knob 20 is turned, it causes gear portion 28 to rotate and the teeth of gear portion 28 interact with gear head 30, causing worm screw 24 to rotate. As worm screw 24 rotates, the worm screw threads on the inner side of second tubular opening 26*b* interact with the threads of worm screw 24 causing guide ring 18 to move axially along radial channel 16.

Figure 3:
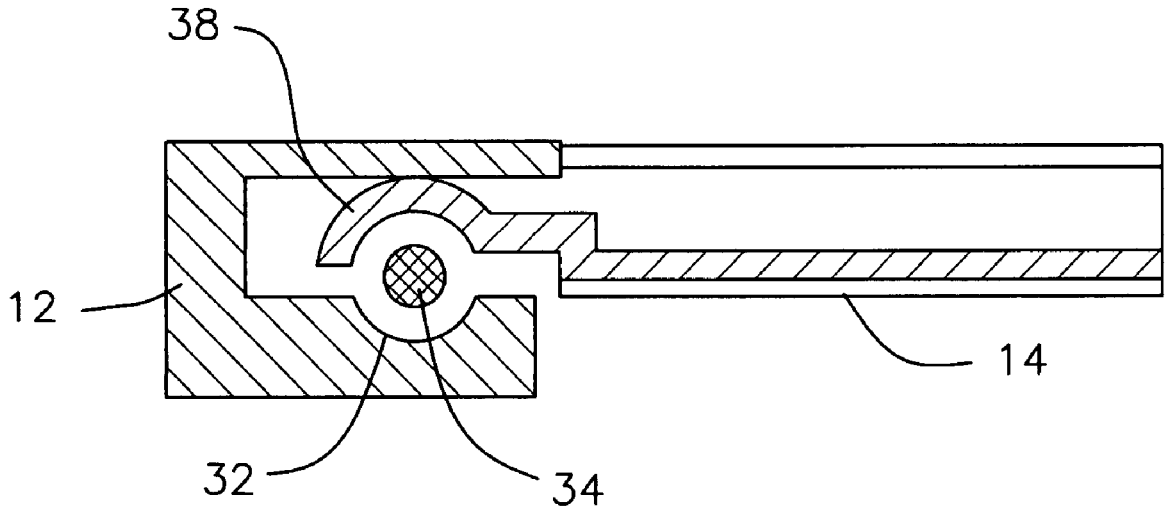
FIG. 3 is a sectional view of one embodiment of the present invention along the section shown in FIG. 2.

Referring to FIG. 3, in the assembly of the rotary disc assembly, the beads 34 are first placed in the grooved inner flange 32 of outer ring frame 12. Rotary disc 14 is placed within the central void of outer ring frame 12. At the same time, the engagement flange 38 of rotary disc 14 is registered with grooved inner flange 32 of outer ring frame 12. The bottom surface of rotary disc 14 is positioned higher than that of outer ring frame 12 when engaged so that rotary disc 14 is not in contact with the sheet material to be cut. Rotary disc 14 rests on ball bearing beads 34 within outer ring frame 12. When rotary disc 14 is rotated, beads 34 facilitate movement and rotary disc 14 glides smoothly along beads 34.

In one embodiment of the present invention, rotary disc 14 is transparent to allow an unobstructed view of the material upon which circle cutting device 10 is being placed. Rotary disc 14 also has concentric circles to assist in centering circle cutting device 10 in the desired location on the material.

Figure 6:
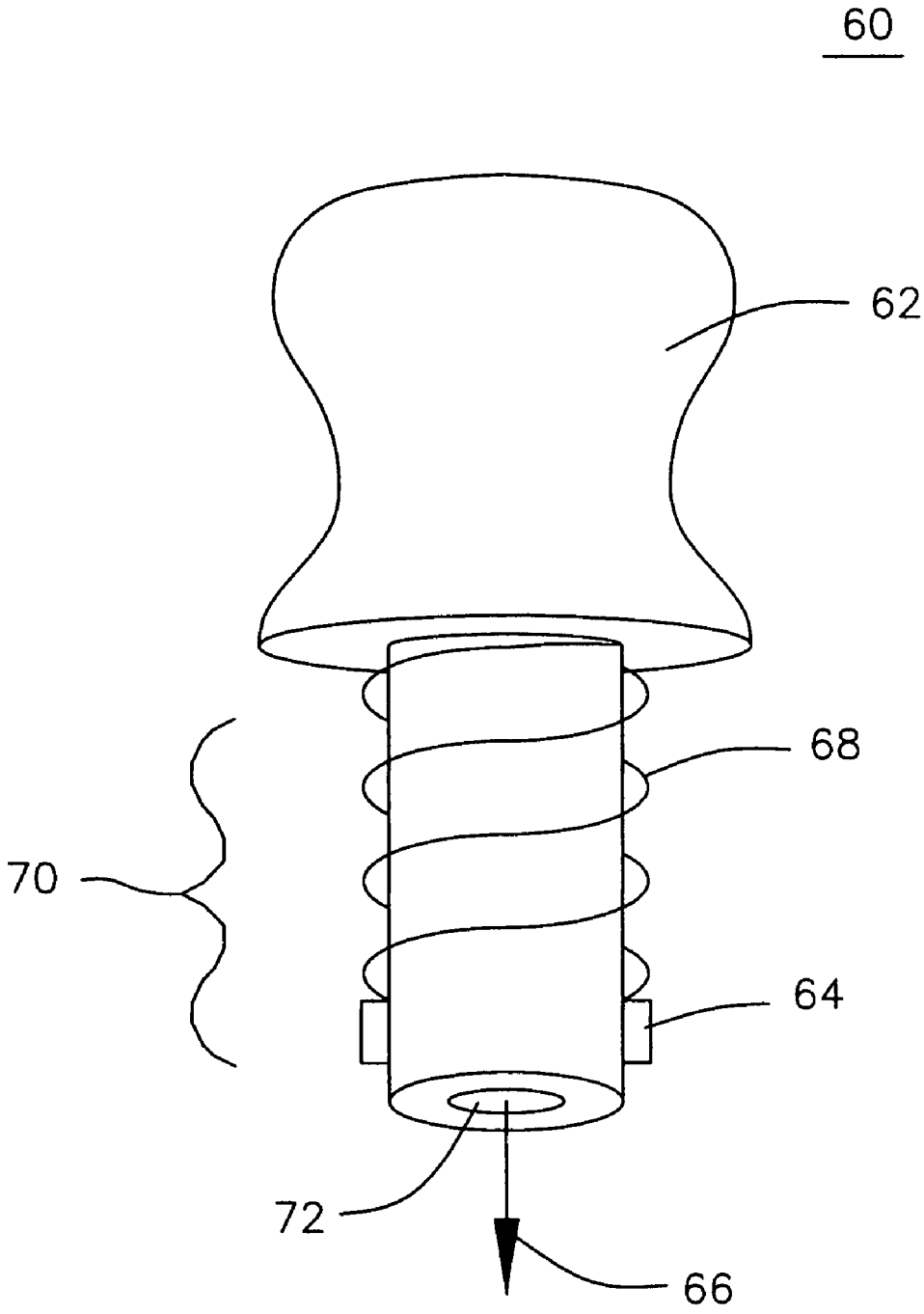
FIG. 6 is a side elevation of a cutting tool of the present invention.

Referring to FIG. 6, one embodiment of cutting tool 60 of the present invention is illustrated; comprising a contoured rotatable head 62, cylindrical body 70, and a removable blade insert 66. Cylindrical body 70 is provided with notch 64 to be inserted into corresponding slot 45 on the inner wall of guide ring 18. A spring 68 wraps around cylindrical body 70. The bottom end of cylindrical body 70 is provided with slot 72 for the insertion of blade insert 66.

Figure 4:
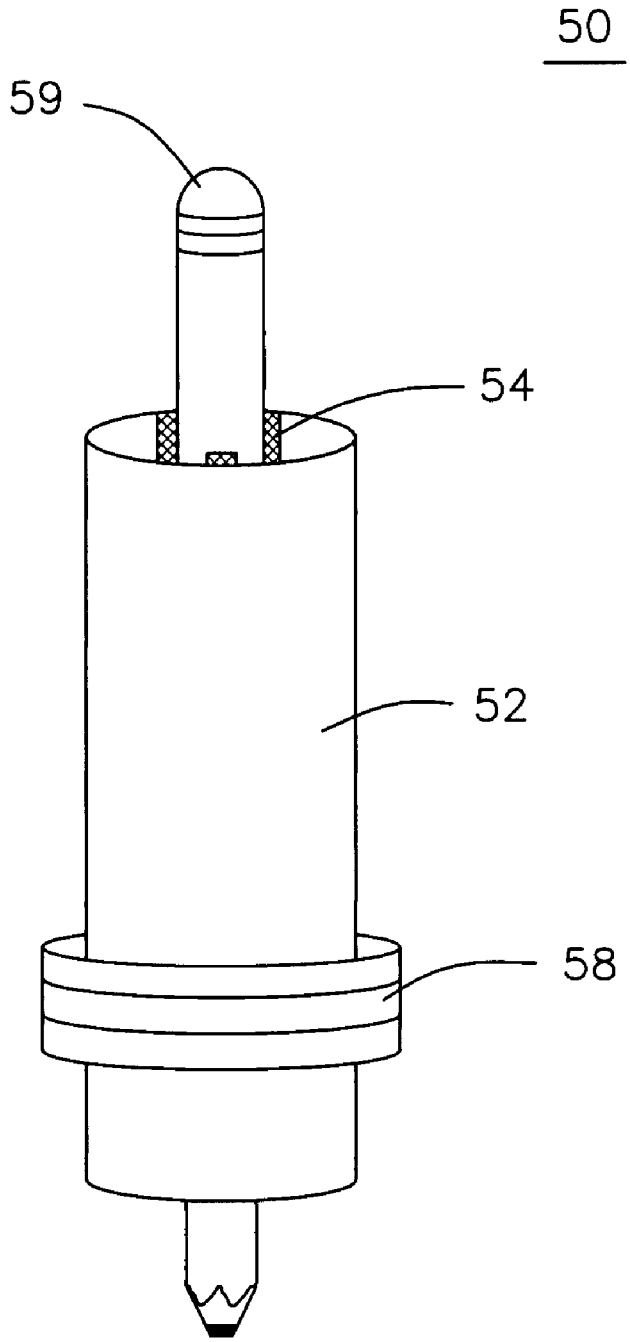
FIG. 4 is a side elevation of a drawing tool in a closed position with a drawing implement therein, in accordance with one embodiment of the present invention.
Figure 5A:
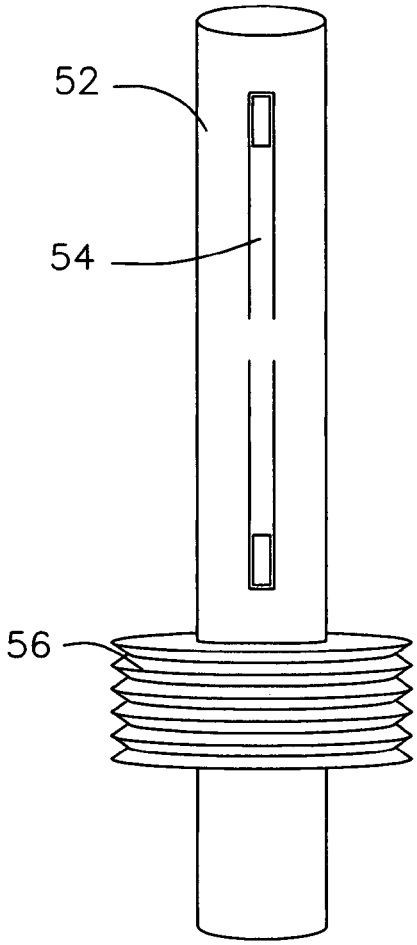
FIG. 5A is a side elevation of the drawing tool of FIG. 4 in a separated position wherein the cylindrical sleeve is shown.
Figure 5B:
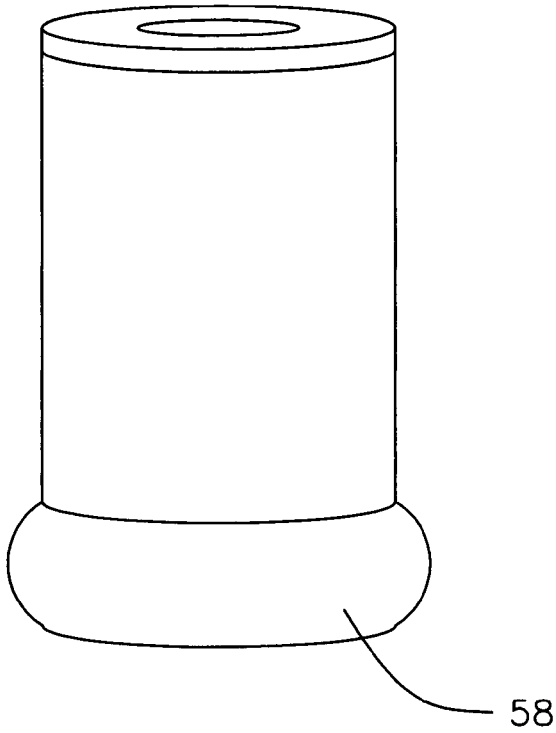
FIG. 5B is a side elevation of the drawing tool of FIG. 4 in a separated position wherein the central screw or knob is shown.

Circle cutting device 10 can also be used in conjunction with a drawing tool in order to draw different size circles on a material. FIGS. 4, 5A and 5B illustrate a drawing tool 50 according to one embodiment of the present invention. Drawing tool 50 has a cylindrical sleeve 52 for the insertion of a writing implement 59. When writing implement 59 is inserted through cylindrical sleeve 52 and drawing tool 50 is inserted into guide ring 18, the tip of writing implement 59 touches the material.

In another embodiment of the present invention, drawing tool 50 can be adjusted so as to stabilize writing implement 59 within drawing tool 50. There is a deflectable locking pincher 54 along the inner side of cylindrical sleeve 52 that are adjustable to fit securely around writing implement 59. Cylindrical sleeve 52 is surrounded by a threading region 56. A central screw ring 58 is rotated around cylindrical sleeve 52 and when threading region 56 interacts with the threading region on the inside of central screw ring 58, deflectable locking pincher 54 is released or retracted depending on the direction of rotation.

The circle cutting device 10 of the present invention can be used interchangeably to cut or draw precise circles. For the purpose of illustration alone, the description of the operation mode will refer to the cutting of circles. The rotary disc assembly 11 is first placed in contact with a flat object to be cut. The material is aligned beneath circle cutting device 10 in the desired position. User decides on the size of the circle he wishes to cut. User turns adjustment knob 20 in order to align guide ring 18 at the desired positioning marking on guide 42. Cutting tool 60 is placed within guide ring 18, inserting notch 64 of cutting tool 60 into corresponding slot 45 of guide ring 18 in order to secure cutting tool 60 within guide ring 18. User rests his hand on positioning surface 40 in order to prevent circle cutting device 10 from shifting out of position. User grasps cutting tool 60 with his other hand and applies pressure while at the same time rotating tool 60 in a circular direction relative to outer ring frame 12. Circle cutting device 10 is removed from the material and a precisely cut circle is revealed.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

We claim:

1. A rotary disc assembly for use with a cutting tool to cut circles from a material, said rotary disc assembly comprising:

an outer ring frame having an inner flange;

a rotary disc rotatably attached to said inner flange of said outer ring frame, said rotary disc having a radial channel with a first side and a second side, so that when said rotary disc is placed on the material and the cutting tool is inserted into said radial channel and affixed therein, and when the cutting tool and said rotary disc are rotated relative to said outer ring frame, the material is cut to form a circle;

a worm screw mounted to the underside of said rotary disc along said first side of said channel; and a guide ring mounted within said radial channel and proximate to said worm screw, for receiving the cutting tool, so that when the cutting tool is inserted into said guide ring, and when said worm screw is rotated, said guide ring and the cutting tool are moved axially along said radial channel.

2. The rotary disc assembly of claim 1 said rotary disc further comprising an adjustment knob mounted on the top side of said rotary disc and coupled to said worm screw, so that when said knob is turned, said worm screw is rotated allowing said guide ring and the cutting tool to move axially along said radial channel.

3. The rotary disc assembly of claim 1 further comprising a slide bar mounted to the underside of said rotary disc along said second side of said radial channel wherein said guide ring is provided with a first tubular opening for receiving said slide bar and a second tubular opening for receiving said worm screw, said second tubular opening having worm screw threads corresponding to the worm screw threads of said worm screw.

4. The rotary disc assembly of claim 1 wherein said rotary disc further comprises an engagement flange, which corresponds to the inner flange of said outer ring frame, said engagement flange having a diameter slightly larger than an inner diameter of said outer ring frame.

5. The rotary disc assembly of claim 1 wherein the bottom surface of said rotary disc is positioned higher than that of said outer ring frame when engaged so that said rotary disc is not in contact with the material.

6. The rotary disc assembly of claim 1 wherein said inner flange of said outer ring frame is grooved for receiving a plurality of beads disposed within said grooved inner flange, so that when said rotary disc rests on said plurality of beads, movement of said rotary disc relative to said outer ring frame is facilitated.

7. The rotary disc assembly of claim 2 said adjustment knob further comprising a gear portion and said worm screw further comprising a gear head mounted on said worm screw, so that when said knob is turned, said worm screw is rotated.

8. The rotary disc assembly of claim 1 wherein said outer ring frame further comprises a positioning surface along the outer side of said outer ring frame.

9. The rotary disc assembly of claim 1, said rotary disc further comprising a guide having positioning markings along the radial side of said radial channel.

10. The rotary disc assembly of claim 1, said guide ring further comprising a slot for receiving a corresponding notch on the cutting tool.

11. The rotary disc assembly of claim 9, said guide ring further comprising a radius indicator protruding toward the markings of said guide.

12. A rotary disc assembly for use with a drawing tool to draw circles on a material, said rotary disc assembly comprising:

an outer ring frame having an inner flange;

a rotary disc rotatably attached to said inner flange of said outer ring frame, said rotary disc having a radial channel with a first side and a second side, so that when said rotary disc is placed on the material and said drawing tool is inserted into said radial channel and affixed therein and a writing implement is inserted into said drawing tool and when said drawing tool and said rotary disc are rotated relative to said outer ring frame, a circle is drawn on the material;

a slide bar mounted to the underside of said rotary disc along said first side of said channel;

a worm screw mounted to the underside of said rotary disc along said second side of said channel; and a guide ring mounted within said radial channel between said slide bar and said worm screw, for receiving said drawing tool, so that when said drawing tool is inserted into said guide ring, and when said worm screw is rotated, said guide ring and said drawing tool are moved axially along said radial channel.

13. The rotary disc assembly of claim 12, wherein said drawing tool is provided with a cylindrical sleeve, so that when a writing implement is inserted through said cylindrical sleeve and said drawing tool is inserted into said guide ring, the writing implement touches the material.

14. The rotary disc assembly of claim 13 wherein said cylindrical sleeve further comprises a deflectable locking pincher along the inner side of said cylindrical sleeve, so that said drawing tool can be adjusted to fit securely around the writing implement.

15. The rotary disc assembly of claim 12 said rotary disc further comprising an adjustment knob mounted on the top side of said rotary disc and coupled to said worm screw, so that when said knob is turned, said worm screw is rotated allowing said guide ring and said drawing tool to move axially along said radial channel.

16. The rotary disc assembly of claim 12, wherein said guide ring is provided with a first tubular opening for receiving said slide bar and a second tubular opening for receiving said worm screw, said second tubular opening having worm screw threads corresponding to the worm screw threads of said worm screw.

17. The rotary disc assembly of claim 12, wherein said inner flange of said outer ring frame is grooved for receiving a plurality of beads disposed within said grooved inner flange, so that when said rotary disc rests on said plurality of beads, movement of said rotary disc relative to said outer ring frame is facilitated.

18. The rotary disc assembly of claim 12 wherein said outer ring frame further comprises a positioning surface along the radial side of said radial channel.

19. The rotary disc assembly of claim 12, said rotary disc further comprising a guide having positioning markings along the radial side of said radial channel.

* * * * *